United States Patent [19]

Taylor

[11] Patent Number: 4,587,798

[45] Date of Patent: May 13, 1986

[54] SAFETY STIRRUP

[76] Inventor: Gregory A. Taylor, Lot 2 New England Highway, Blandford, New South Wales 2338, Australia

[21] Appl. No.: 706,486

[22] Filed: Feb. 28, 1985

[30] Foreign Application Priority Data

Mar. 1, 1984 [AU] Australia ..... PG3855

[51] Int. Cl.[4] ..... B68C 3/02

[52] U.S. Cl. ..... 54/49

[58] Field of Search ..... 54/49, 47, 49.5

[56] References Cited

U.S. PATENT DOCUMENTS 795,050 7/1905 Markley ..... 54/49

985,346 2/1911 Hunter ..... 54/49

*Primary Examiner*—Hugh R. Chamblee

*Attorney, Agent, or Firm*—Ladas & Parry

[57] ABSTRACT

A safety stirrup which has two arms arranged in a generally parallel co-extensive spaced relationship, a foot engaging base attached to one of the arms and supported by the other arm, and wherein the base and one of the arms are pivotally attached to the other arm so that upon a rider being dislodged from the saddle, the rider's foot will apply a transverse force to the stirrup thereby causing pivoting of the base to eject the rider's foot from within the stirrup.

7 Claims, 4 Drawing Figures

SAFETY STIRRUP

This invention relates to safety stirrups.

When a rider is dislodged from the saddle, occasionally instead of being thrown clear, one of the rider's legs is caught at or about the ankle and retained in the stirrup. Consequently the rider may be dragged along the ground until the horse comes to rest voluntarily or otherwise. This can and does result in serious injury to the rider.

In order to overcome the above problem, several safety stirrups have been proposed. For example, safety stirrups are described in U.S. Pat. Nos. 3,555,781, 4,209,962 and 3,816,974.

U.S. Pat. No. 3,555,781 merely describes a safety stirrup with one of the sides of the stirrup omitted. It is contended that when the rider is thrown from the horse, the missing side of the stirrup allows the rider's foot to clear the stirrup. U.S. Pat. No. 4,208,962 describes a stirrup with the two sides of the stirrup being pivotally attached and joined by a base which is pivotally attached to one of the sides. Once the rider is thrown from the horse, the two sides of the stirrup pivot relative to each other thereby allowing disengagement of the base and the release of the rider's foot. U.S. Pat. No. 3,816,974 describes a stirrup with a main attachment portion to be fixed to the saddle and a foot engaging portion resiliently but removably attached to the main attachment portion. Upon the rider being thrown from the horse, the foot engaging portion is disengaged from the main attachment portion.

The above described earlier safety stirrups however are not totally effective in that the foot still does not clear the stirrup or alternatively the stirrup safety feature is activated in circumstances when the rider is not thrown from the horse.

It is the object of the present invention to overcome or substantially ameliorate the above disadvantages.

There is disclosed herein a safety stirrup comprising a main body portion to engage a saddle strap so as to be supported thereby, said body portion having two side arms which in use, extend generally downward in a spaced generally co-extensive relationship, and a foot engaging base extending between the lower extremities of said arms and engaging same so as to be supported thereby in a foot engaging horizontal position, and wherein one of said arms at its upper extremity releasably engages the remainder of said body portion, and said base is fixed to the lower extremity of said one arm, with said one arm and base being pivotally attached to the lower extremity of the other arm so that upon a lateral force being applied to said one arm, said one arm and base pivot to a release position dislodging a rider's foot from within the stirrup.

A preferred form of the present invention will now be described by way of example with reference to the accompanying drawings, wherein.

Figure 1:
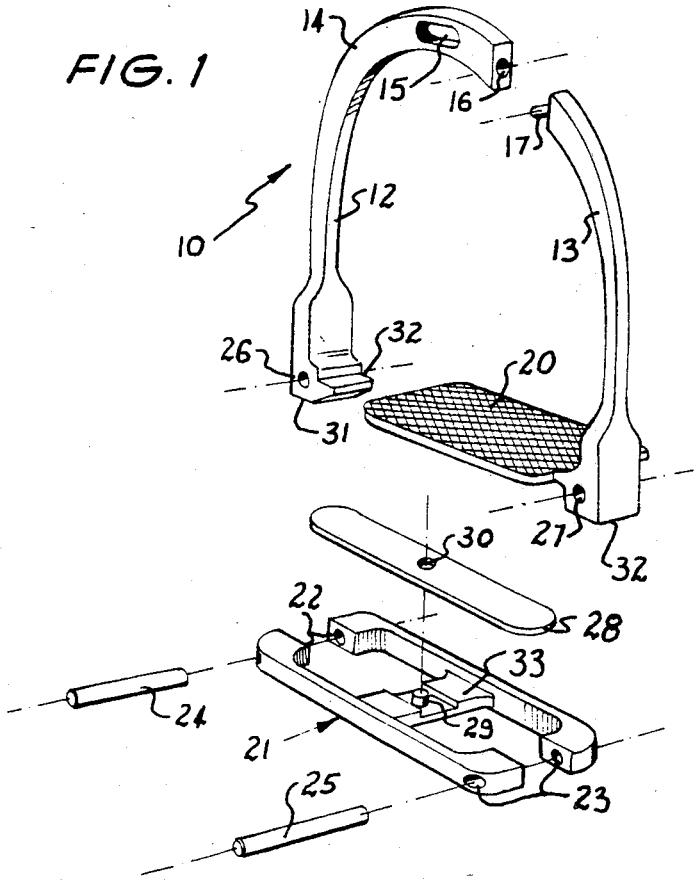
FIG. 1 is a schematic parts exploded perspective view of a safety stirrup.

In FIGS. 1 to 4 there is schematically depicted a safety stirrup 10 which consists of a main body portion 11 having two generally vertically extending parallel co-extensive transversely spaced side arms 12 and 13. Formed integral with the arm 12 is an attachment portion 14 having an aperture 15 enabling the safety stirrup 10 to be attached to a saddle by means of a saddle strap. The upper extremity of the arm 13 is releasably secured to the attachment portion 14 by means of an aperture 16 formed in the attachment portion 14, and a pin 17 extending from the upper extremity of the arm 13. It should be appreciated that the aperture 16 and pin 17 extend downwardly at an angle so that the arm 13 is secured in position.

Attached to the lower extremities of the arms 12 and 13 is a foot supporting assembly 19 consisting of a foot engaging member 20 rigidly fixed to the lower extremity of the arm 13. The assembly 19 also includes a base frame 21, which extends generally between the lower extremities of the arms 12 and 13. Each end of the base frame 21 is provided with a passage 22 or 23 to receive a pivot pin 24 or 25. Additionally the lower extremities of the arms 12 and 13 are provided with passages 26 and 27 through which the pins 24 and 25 pass. Accordingly, the base frame 21 is pivotally attached to both the arms 12 and 13 at their lower extremities. Supported by the base frame 21 is a leaf spring 28 retained in position on the base frame 21 by means of a pin 29 which is received within an aperture 30 formed in the spring 28. The spring 28 is of a length so as to abut the planar surfaces 31 and 32 at the lower extremities of the arms 12 and 13 respectively. The pin 29 is formed integral with a cross member 33, of the base frame 21, so that the spring 28 is resiliently deformed when the safety stirrup 10 is in its normal working configuration. i.e. the spring 30 extends between the two planar surfaces 31 and 32 after passing above the cross member 33. While in this position, the spring 28 is in a bowed configuration thereby being pretensioned.

The lower extremity of the arm 12 is also formed with a step 32 upon which the extremity of the foot engaging member 20 rests.

Figure 2:
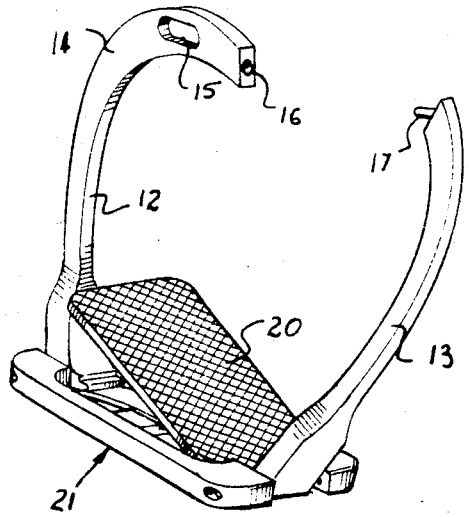
FIG. 2 is a schematic perspective view of the safety stirrup of FIG. 1 in an assembled condition and partly actuated to release a rider's foot from within the stirrup.
Figure 3:
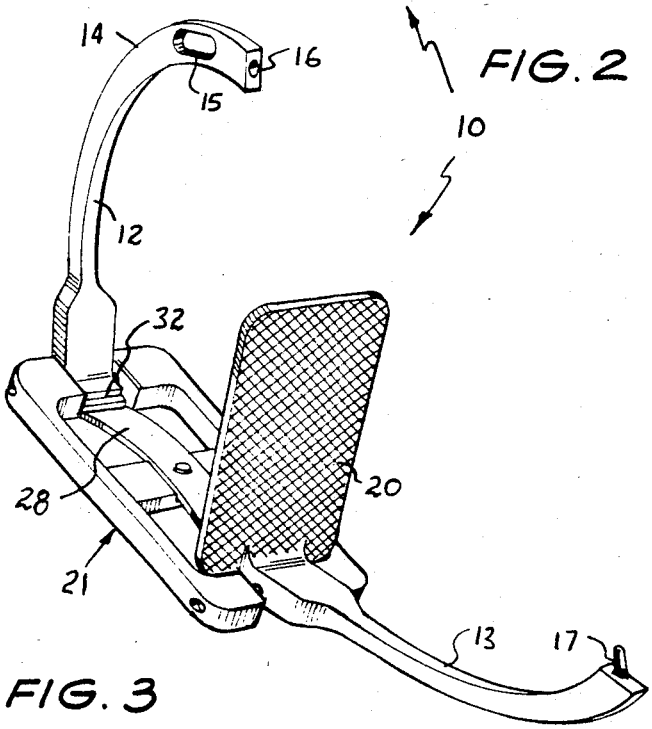
FIG. 3 is a schematic perspective view of the stirrup of FIG. 2 in a further actuated position.
Figure 4:
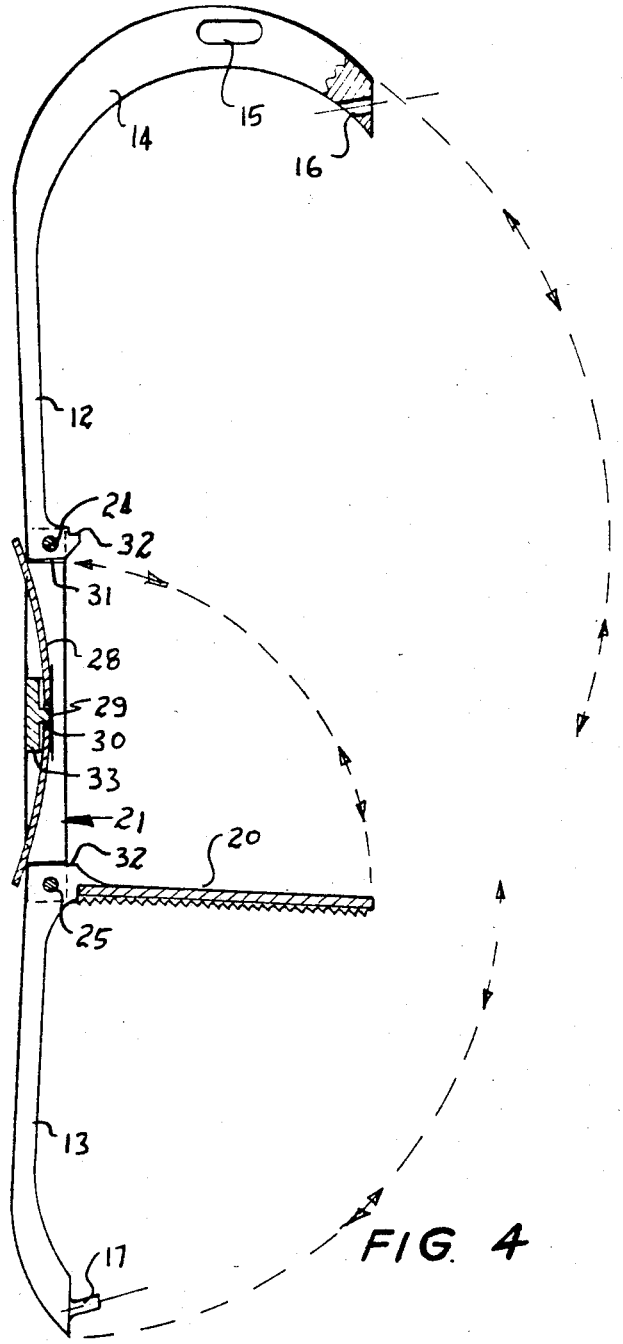
FIG. 4 is a schematic side elevation of the stirrup of FIG. 1 in a full release position.

It should be appreciated from the above described preferred embodiment, that the spring 28 generally retains the safety stirrup 10 in the normal working configuration. Upon a rider applying sufficient force in a direction transverse of the arm 13 and outwardly relative to the horse, the arm 13 is caused to pivot, initially as depicted in FIG. 2. This movement of the arm 13 will continue until the stirrup has the configuration of FIG. 3, and if further release is required, the base frame 21 will pivot about the pin 24 until the safety stirrup 10 reaches the configuration depicted in FIG. 4.

As can be seen from the above description, the foot engaging member 20 is caused to pivot with the arm 23 thereby pushing the foot of the rider from within the stirrup 10. Still further, it should be appreciated that at arriving at the configuration of FIG. 4, the spring 28 is further resiliently deformed.

The above described preferred embodiment of the present invention has the distinct advantage of having the base 24 movable so as to eject the rider's foot from within the stirrup 10.

What I claim is:

1. A safety stirrup comprising: a main body portion having two side arms which in use extend generally downwardly from a saddle strap in a spaced generally coextensive relationship with one of said arms at its upper end being adapted to be attached to said saddle strap; a base extending between the lower extremities of said arms and pivotally supported by same; and a foot engaging member fixed to the other arm, to said one arm, and extending therefrom so as to be located between said arms and above said base, and wherein said arms are releasably attached at their upper ends so that upon a lateral force being applied to said other arm, said arms disengage at their upper ends and said base and said other arm pivot to dislodge a rider's foot from within the stirrup by movement of said foot engaging member.

2. The safety stirrup of claim 1 further including resilient means biasing said arms to a normal working position retaining the rider's foot within the stirrup.

3. The stirrup of claim 2 wherein said resilient means is a spring mounted on said base and engaging said arms to bias said arms to a normal working position retaining the rider's foot within the stirrup.

4. The stirrup of claim 3 wherein said one arm has its lower extremity a step upon which said foot engaging member rests during normal operation of the stirrup.

5. The stirrup of claim 4 wherein the upper extremity of said other arm is provided with a pin, and said one arm is provided with a passage to receiver said pin.

6. The stirrup of claim 5 wherein said pin and passage extend in a direction at an acute angle to the horizontal.

7. The stirrup of claim 6 wherein said spring is a leaf spring which abuts the lower extremities of the two arms.

* * * * *